US005374511A

United States Patent [19]

Leyshon et al.

[11] Patent Number: 5,374,511

[45] Date of Patent: Dec. 20, 1994

[54] PHOTOGRAPHIC COLOR COUPLERS AND PHOTOGRAPHIC MATERIALS CONTAINING THEM

[75] Inventors: Llewelyn J. Leyshon; David Clarke, both of Watford/Herts, United Kingdom

[73] Assignee: Eastman Kodak Company, Rochester, N.Y.

[21] Appl. No.: 70,443

[22] Filed: Jun. 7, 1993

[30] Foreign Application Priority Data

Dec. 6, 1990 [GB] United Kingdom ..... 9026557

[51] Int. Cl.[5] ..... G03C 7/38

[52] U.S. Cl. ..... 430/558; 430/543

[58] Field of Search ..... 430/558, 543

[56] References Cited

U.S. PATENT DOCUMENTS 5,155,016 10/1992 Mizukawa et al. ..... 430/558

FOREIGN PATENT DOCUMENTS 0177765 4/1986 European Pat. Off. .
0234428 9/1987 European Pat. Off. .
2160233 6/1990 Japan .
191948 7/1990 Japan .
195345 8/1990 Japan .
201358 8/1990 Japan .
300744 12/1990 Japan .
9010253 9/1990 WIPO ..... 430/558

*Primary Examiner*—Lee C. Wright
*Attorney, Agent, or Firm*—Arthur E. Kluegel

[57] ABSTRACT

A 1-H-pyrazolo-[1,5-b]-1,2,4-triazole having a combination of an arylthio coupling-off group and a tertiary alkyl group attached via its tertiary carbon atom in the 6-position preferably has the general formula:

wherein $R^1$ is a tertiary alkyl group, $R^2$ is an alkyl or substituted alkyl group, and X is a thioaryl or substituted thioaryl group.

5 Claims, No Drawings

PHOTOGRAPHIC COLOR COUPLERS AND PHOTOGRAPHIC MATERIALS CONTAINING THEM

This invention relates to photographic colour couplers and particularly to 1-H-pyrazolo[1,5-b]-1,2,4-triazole couplers.

1-H-pyrazolo[1,5-b]-1,2,4-triazole couplers and related pyrazoloazole couplers which form magenta image dyes are now widely known in photography. European Specification 0 177 765 describes pyrazoloazoles having a branched alkyl or substituted alkyl group in a variety of possible positions. The image dyes formed therefrom are said to have improved light fastness and improved colour reproducibility. Among the couplers listed in the specification, M-35 is a 1-H-pyrazolo[1,5-b]-1,2,4-triazole having an aryloxy coupling-off group in the 7-position and a branched hydroxyalkyl group in the 6-position. In the working Examples the only specific couplers of the invention have chloro coupling-off groups and a branched alkyl group in the 6-position. The results show that the substitution of methyl by isopropyl or t-butyl results in an improvement in light fastness of the corresponding image dye.

European Specification 0 234 428 describes various types of pyrazoloazoles having alkyl-, aralkyl-, cycloalkyl-, aryl- or heterocylyl-thio coupling-off groups which are said to increase fastness and colour density at a "fast colouring speed". Examination of the experimental results obtained in the specification indicates that while changing the coupling-off group from chloro to an arylmercapto group increases the light fastness of the corresponding dye, in those cases where a coupler having a 6-alkoxy group can be compared with 6-methyl or 6-isopropyl analogues, no change in light fastness is observed when moving from a 6-alkoxy substituent to a 6-methyl or 6-isopropyl substituent.

According to the present invention therefore there is provided 1-H-pyrazolo[1,5-b]-1,2,4-triazole couplers of the general formula:

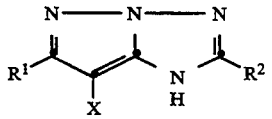

wherein $R^1$ is a tertiary alkyl group, $R^2$ is an alkyl or substituted alkyl group, and X is a thioaryl or substituted thioaryl group which is free from orthocarbonamido substituents on the aryl group.

Couplers of the present invention provide image dyes having improved light fastness. The present couplers provide image dyes of superior light-fastness to couplers which contain only the arylthio or branched alkyl group. Such a combination of substituent groups and the effect on dye properties that they provide is not disclosed or suggested in the prior art.

$R^2$ is preferably a ballast group, that is, a group which has a size and configuration such that it renders the coupler non-wandering in photographic layers. In one embodiment of the present invention this group too comprises an α-branched alkyl moeity.

The preferred coupling-off groups X have the general formula:

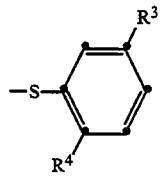

wherein $R^3$ is hydrogen or an alkyl group having from 1 to 8 carbon atoms, preferably 3–5 and particularly 4 carbon atoms, and $R^4$ is an alkoxy group having from 1 to 8 carbon atoms, preferably 3–5 and particularly 4 carbon atoms.

Examples of groups which $R^1$ may represent have the formula:

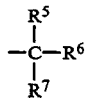

wherein $R^5$, $R^6$ and $R^7$ are each independently an alkyl or substituted alkyl groups or an alkenyl group. Preferred substituents for such groups include —OH, —$NH_2$, —COOH, —CONR—, —NRCO—, —$SO_2$NR—, —NR$SO_2$— or an aryl group, wherein R is an alkyl or aryl group.

$R^1$ may also be a ballast group.

Specific examples of groups which $R^1$ may represent are t-butyl, t-amyl, t-octyl and groups of the formula:

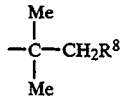

wherein $R^8$ is —OH, —NH—$SO_2$Me or —NH-$COOC_{10}H_{21}$.

Examples of couplers according to the present invention are listed below. The group t-octyl has the formula:

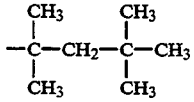

-continued
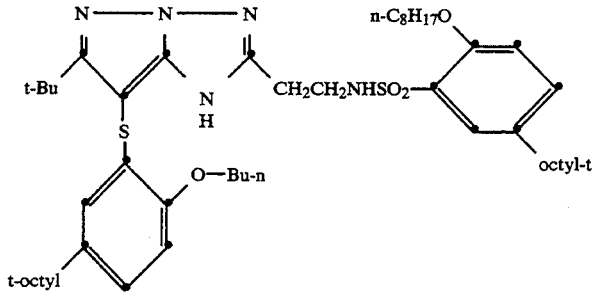
(1)
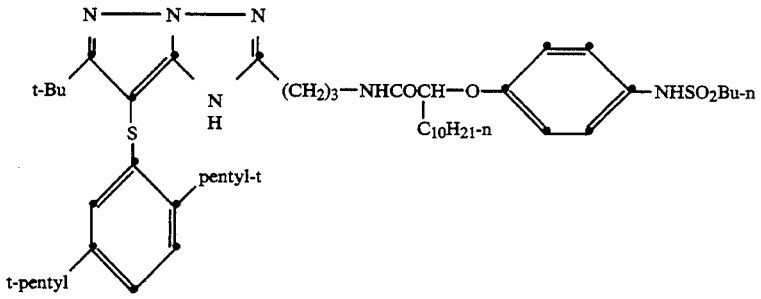
(2)
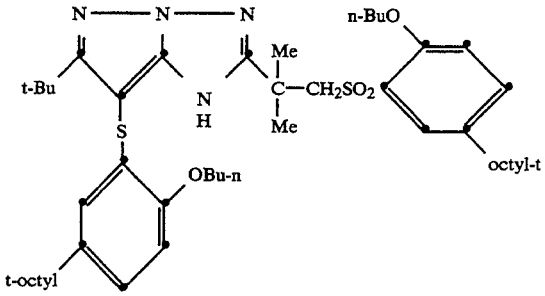
(4)
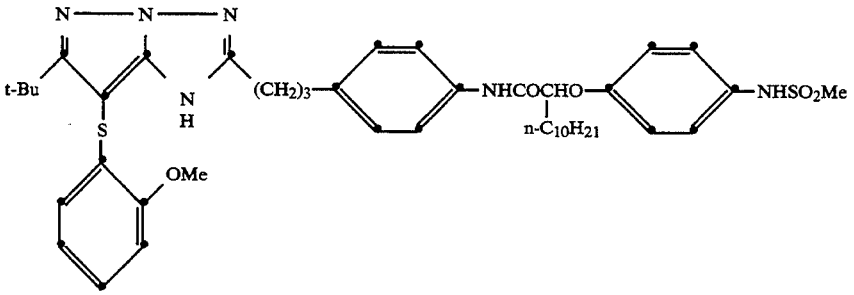
(5)
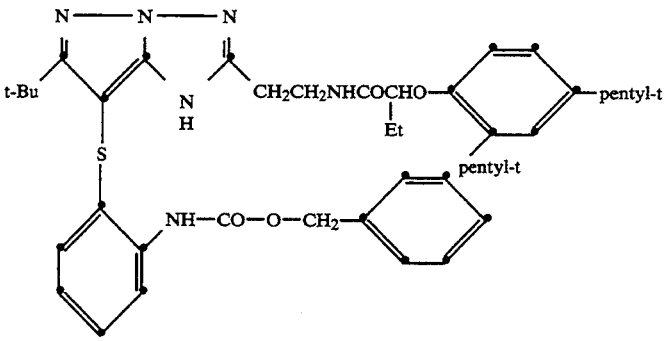
(6)

-continued (7)

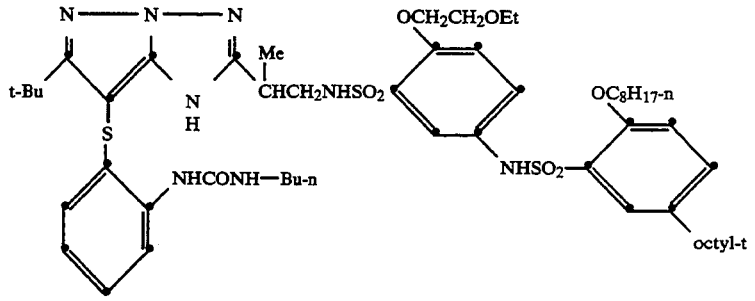

(5)

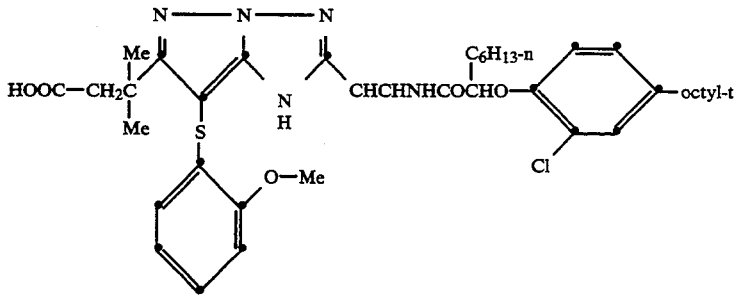

(6)

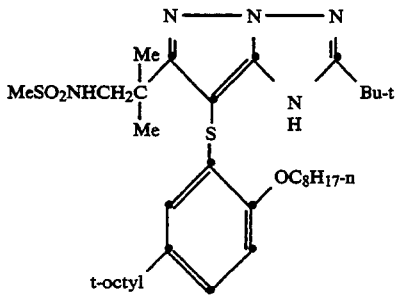

(7)

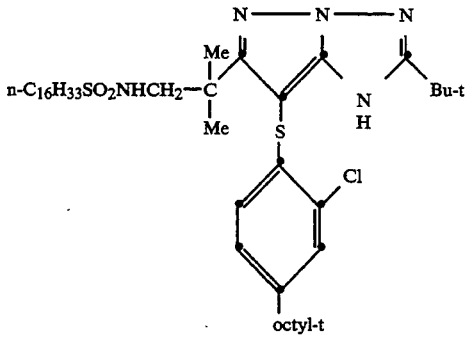

The present couplers may be prepared by methods, in themselves, known to the organic chemist. An example of their preparation is given in the Examples below and in European Specification 0 177 765.

Typically, the couplers are associated with a silver halide emulsion layer coated on a support to form a photographic element. As used herein, the term "associated with" signifies that the coupler is incorporated in the silver halide emulsion layer or in a layer adjacent thereto where, during processing, it is capable of reacting with silver halide development products.

The photographic elements can be single colour elements or multicolour elements. In a multicolour element, the magenta dye-forming couplers of this invention would usually be associated with a green-sensitive emulsion, although they could be associated with an emulsion sensitised to a different region of the spectrum, or with a panchromatically sensitised, orthochromatically sensitised or unsensitised emulsion. Multicolour elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolour photographic element comprises a support bearing yellow, magenta and cyan dye image-forming units comprising at least one blue-, green- or red-sensitive silver halide emulsion layer having associated therewith at least one yellow, magenta or cyan dye-forming coupler respectively, at least one of the magenta dye-forming couplers being a coupler of this invention. The element can contain additional layers, such as filter and barrier layers.

In the following discussion of suitable materials for use in the emulsions and elements of this invention, reference will be made to Research Disclosure, December 1978, Item 17643, published by Industrial Opportunities Ltd., The Old Harbourmaster's, 8 North Street, Emsworth, Hants P010 7DD, U.K. This publication will be identified hereafter as "Research Disclosure".

The silver halide emulsion employed in the elements of this invention can be either negative-working or positive-working. Suitable emulsions and their preparation are described in Research Disclosure Sections I and II and the publications cited therein. Preferred emulsions are at least 80% molar in silver chloride, preferably at least 90% molar and especially essentially pure silver chloride. Suitable vehicles for the emulsion layers and other layers of elements of this invention are described in Research Disclosure Section IX and the publications cited therein.

In addition to the couplers of this invention, the elements of the invention can include additional couplers as described in Research Disclosure Section VII, paragraphs D, E, F and G and the publications cited therein. The couplers of this invention and any additional couplers can be incorporated in the elements and emulsions as described in Research Disclosures of Section VII, paragraph C and the publications cited therein.

The photographic elements of this invention or individual layers thereof, can contain brighteners (see Research Disclosure Section V), antifoggants and stabilisers (see Research Disclosure Section VI), antistain agents and image dye stabilisers (see Research Disclosure Section VII, paragraphs I and J), light absorbing and scattering materials (see Research Disclosure Section VIII), hardeners (see Research Disclosure Section XI), plasticisers and lubricants (see Research Disclosure Section XII), antistatic agents (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a colour developing agent to reduce developable silver halide and oxidise the colour developing agent. Oxidised colour developing agent in turn reacts with the coupler to yield a dye.

Preferred colour developing agents are p-phenylene diamines. Especially preferred are 4-amino-3-methyl-N,N-diethylaniline hydrochloride, 4-amino-3-methyl-N-ethyl-N-β-(methanesulphonamido)ethylaniline sulphate hydrate, 4-amino-3-methyl-N-ethyl-N-β-hydroxyethylaniline sulphate, 4-amino-3-β-(methanesulphonamido)ethyl-N,N-diethylaniline hydrochloride and 4-amino-N-ethyl-N-(2-methoxy-ethyl)-m-toluidine di-p-toluene sulphonate.

With negative-working silver halide emulsions this processing step leads to negative image. To obtain a positive (or reversal) image, this step can be preceded by development with a non-chromogenic developing agent to develop exposed silver halide, but not form dye, and then uniform fogging of the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The following examples are included for a better understanding of the invention.

EXAMPLE 1

Synthesis of Coupler (1)

Preparation of couplers used in the present invention, may be achieved by thioarylation of the parent (4-equivalent) pyrazolotriazole coupler. The latter may be synthesised by standard methods disclosed in EP119,860 and EP177,765 for example.

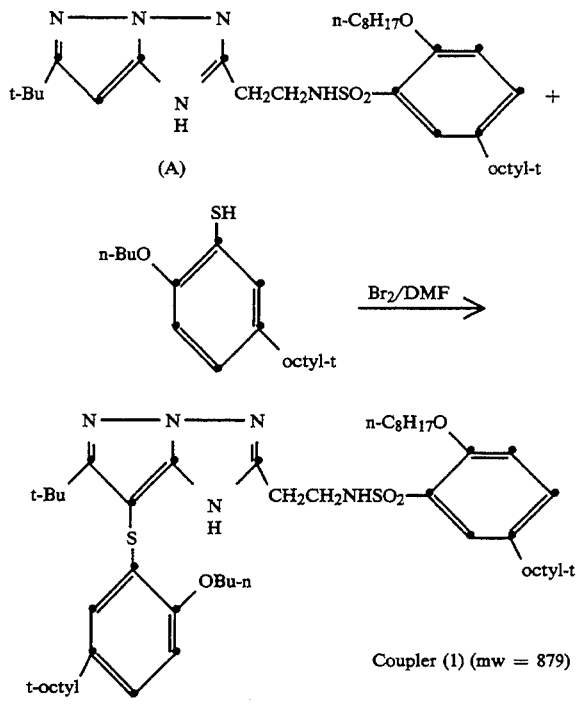

The pyrazolotriazole coupler A (6.0 g, 0.01 mole) was stirred in dimethylformamide (30 ml) and cooled in an ice bath to 5° C. 2-n-Butoxy-5-t-octyl-benzenethiol (3.2, 0.01 mole) was added in one charge followed by the dropwise addition of bromine (2.4 g, 0.015 mole) in DMF (20 ml). When the addition was complete, the solution was stirred for 2 hours allowing the temperature to rise to its ambient value. The reaction mixture was then partitioned between ethyl acetate (250 ml) and 0.1M hydrochloric acid (250 ml). The organic layer was separated and dried over $MgSo_4$, then the solvent was removed under reduced pressure to give the crude coupler as an orange coloured oil. Column chromatography on silica gel, eluting with 6:1 (v/v) 60–80 petroleum ether/ethyl acetate, gave coupler (1) as a colourless oil which solidified to a waxy solid on standing.

Yield=6.2 g (69%), mp. 82°–84° C. HPLC gave a coupler purity of 99.5% Mass spectrometry gave MH+ as 880 Analysis Found: C,68.1; H,9.3; N,7.4; S,6.9% $C_{50}H_{81}N_5O_4S_2$ Requires: C,68.2; H,9.3; N,8.0; S,7.3%

The 100 MHz H-1 NMR spectrum of the product (CDCl3) confirmed the coupler structure and showed traces of residual, occluded petroleum ether.

EXAMPLE 2

Coupler dispersions were prepared as follows from three comparative couplers and Coupler 1 of the present invention. The couplers were dissolved in a mixture of dibutyl phthalate and ethyl acetate together with an antioxidant stabiliser having the formula:

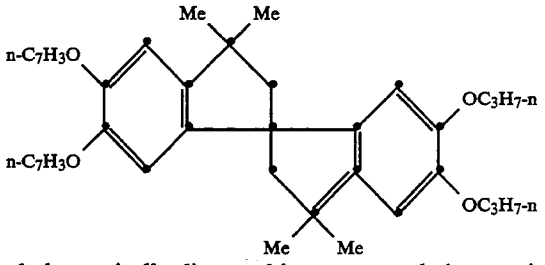

and ultrasonically dispersed in aqueous gelatin containing ALKANOL XC (Trade Mark) surfactant. The ratio of components in the dispersion oil phase was coupler:-dibutyl phthalate:antioxidant=1.0:1.5:0.5.

Each dispersion was independently mixed with a green-sensitised silver chloride photographic emulsion and spread on resin-coated paper support such that the coverage of each coupler was 0.57 mmole/sq m. A UV-absorbing overcoat was also applied to the coatings. The coatings were exposed and processed through RA4 processing chemistry and the resultant images were subjected to a high-intensity light fading experiment. Sample strips were faded under a 50 Klux Xenon arc source for 28 days and the loss in green density from an initial value of 1.0 was recorded. The results are set out in the table below.

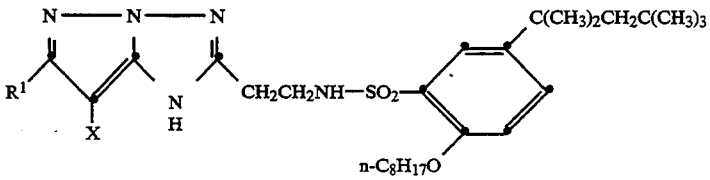

| COUPLER | R | X | FADE (D = 1.0) (50 Klux, 28 day) |
|---|---|---|---|
| Ia | MeO | S—Ar | −0.46 |
| Ib | MeO | Cl | −0.89 |
| Ic | t-Bu | Cl | −0.43 |
| 1 | t-Bu | S—Ar | −0.24 |

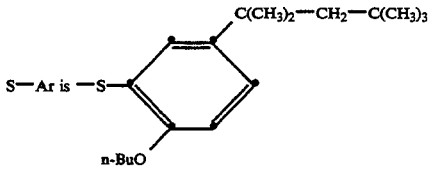

The results show that the improvement in light stability in Coupler 1 of the present invention is due to the presence of both the arylthio coupling-off group and the branched alkyl group in the 6-position.

We claim:

1. A photographic material comprising a support bearing at least one photosensitive silver halide emulsion of which the halide is at least 80% molar chloride having in or adjacent the emulsion layer a 1-H-pyrazolo-[1,5-b]-1,2,4-triazole having the formula:

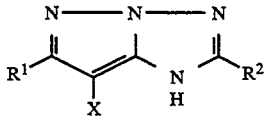

wherein $R^1$ is a tertiary alkyl group having the formula:

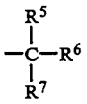

wherein $R^5$, $R^6$, and $R^7$ are each independently an alkyl or substituted alkyl group or an alkenyl group;

$R^2$ is an alkyl or substituted alkyl group; and

X is a group having the formula:

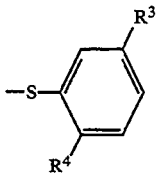

wherein $R^3$ is hydrogen or an alkyl group having from 1 to 8 carbon atoms and $R^4$ an alkoxy group having from 1 to 8 carbon atoms.

2. The element of claim 1 wherein $R^3$ contains from 3 to 5 carbon atoms.

3. The element of claim 1 wherein $R^4$ contains from 3 to 5 carbon atoms.

4. The element of claim 1 wherein $R^2$ comprises a tertiary alkyl group.

5. The element of claim 1 wherein the $R^1$ is selected from the group consisting of t-amyl, t-octyl, and t-butyl.

* * * * *